US008186094B2

(12) United States Patent
AlKandari

(10) Patent No.: US 8,186,094 B2
(45) Date of Patent: May 29, 2012

(54) DEVICE AND METHOD FOR ALIGNING OR ADJUSTING SIGHT FOR A FIREARM

(76) Inventor: Adel A. H. H. A. AlKandari, Dhayat Abdullah Almubarak (KW)

( * ) Notice: Subject to any disclaimer, the term of this patent is extended or adjusted under 35 U.S.C. 154(b) by 26 days.

(21) Appl. No.: 12/723,742

(22) Filed: Mar. 15, 2010

(65) Prior Publication Data

US 2011/0219658 A1 Sep. 15, 2011

(51) Int. Cl.
*F41G 1/00* (2006.01)

(52) U.S. Cl. ..... 42/116; 42/121

(58) Field of Classification Search ..... 42/116, 42/121

See application file for complete search history.

(56) References Cited

U.S. PATENT DOCUMENTS

| | | | | |
|---|---|---|---|---|
| 3,927,480 | A | 12/1975 | Robertsson | |
| 5,787,631 | A * | 8/1998 | Kendall | 42/116 |
| 6,151,788 | A * | 11/2000 | Cox et al. | 33/286 |
| 6,269,581 | B1 | 8/2001 | Groh | |
| 6,311,424 | B1 | 11/2001 | Burke | |
| 6,513,251 | B2 | 2/2003 | Huang | |
| 6,606,797 | B1 * | 8/2003 | Gandy | 33/227 |
| 6,962,532 | B2 | 11/2005 | Hasebe | |
| 7,437,848 | B2 | 10/2008 | Chang | |

* cited by examiner

*Primary Examiner* — Gabriel Klein
(74) *Attorney, Agent, or Firm* — Lowe Hauptman Ham & Berner, LLP

(57) ABSTRACT

The combination of a firearm and a device for aligning an adjustable sight element of an open sight or telescopic sight is disclosed. The combination includes a firearm having a longitudinally extending barrel, a bore extending through the barrel and a longitudinally extending optical axis extending through the bore and an open or telescopic sight with an adjustment mechanism on the barrel of the firearm. The combination also includes a generally bullet shaped device having a metal body including a forward cylindrical portion and a rear cylindrical portion with a larger diameter than the forward portion abutting the forward portion as well as a laser pointer and battery powering the laser pointer disposed in the rear cylindrical portion and wherein the forward cylindrical portion is constructed and dimensioned to slidingly fit within a rear portion of the bore so that the laser pointer projects the light beam through the barrel and along the longitudinal axis and out of said barrel to thereby form a light spot on a distant target. Then the open or telescopic sight can be aligned with the light spot to thereby zero the firearm. In a preferred embodiment of the invention the laser pointer includes a red/orange diode to produce a laser beam with an output power of no greater than 1 milliwatt and a wavelength of about 635 nanometers.

1 Claim, 3 Drawing Sheets

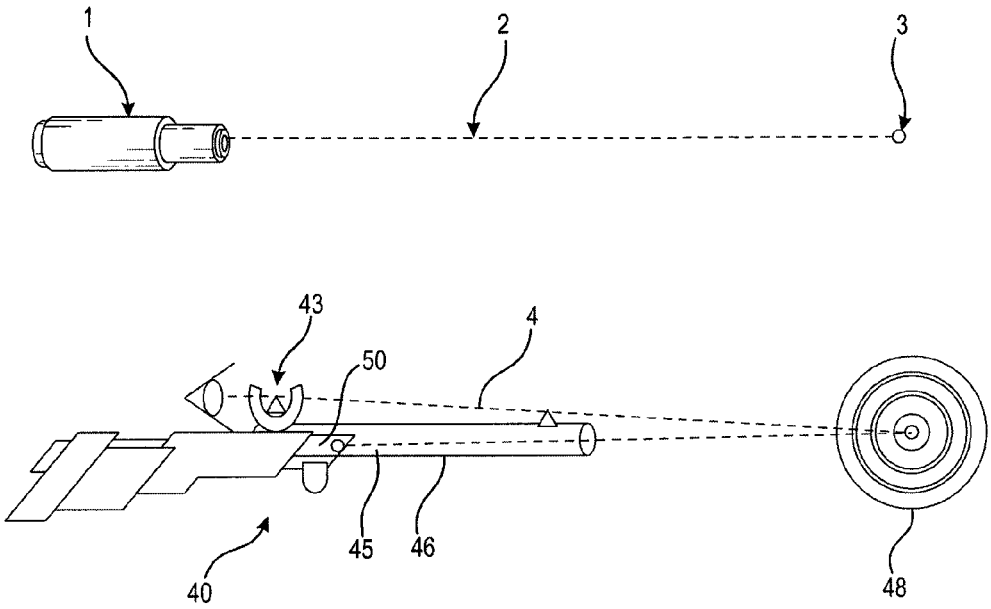
FIG. 4
FIG. 5
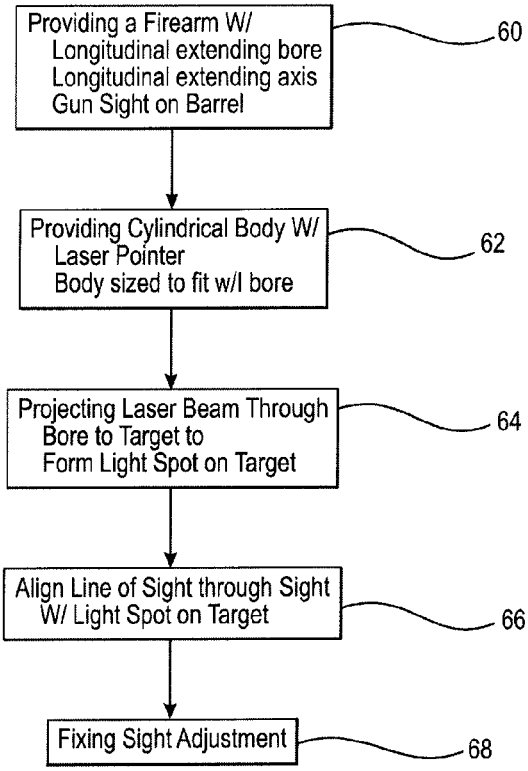

DEVICE AND METHOD FOR ALIGNING OR ADJUSTING SIGHT FOR A FIREARM

FIELD OF THE INVENTION

This invention relates to a device and/or method for aligning an adjustable sight element of an open, peep sight or telescopic sight on a firearm and more particularly to a combination of a firearm and a device for aligning an adjustable element of an open or telescopic sight on the firearm.

BACKGROUND FOR THE INVENTION

Devices for aligning an adjustable sight element in sight systems are well known and have been in use for a number of years. For example, a U.S. Pat. No. 4,554,745 of Repa discloses an adjustable sight element for a rifle that comprises an aperture disc for a peep sight and an adjustable sight structure for a telescopic sight. The adjustable sight element is adjustably mounted for movement about a vertical axis and a horizontal axis in a stationary housing attached to a rifle. The magnitude or degree of the vertical and horizontal displacement of the adjustable sight element is indicated by a capacitance or optronic measuring device and is displayed digitally in electronic digital fields. The electronic component is located in a casing which is removably attached to the housing.

A more recent patent of DeBatty et al., U.S. Pat. No. 5,222,302 discloses a firearm sight aligner for mounting in the bore of a firearm includes a collimator arrangement having a defuser, a sighting grid, and an objective lens. The sighting grid is mounted in the collimator arrangement so that its position can be adjusted in azimuth and elevation in response to movement of exterior mounted adjusting screw mechanisms. The adjusting screw mechanisms each include a multi-start threaded screw in order to enable full translation of the grid over its full range of azimuth and elevation in one 360° revolution of each of the adjusting screw mechanisms.

A further approach to a gun sight zero checking device is disclosed in a U.S. patent of Johnson, U.S. Pat. No. 6,584,720. As recognized by Johnson, rifle righting devices, particularly telescopic sights are susceptible to movement on account of being dropped or bumped. At times, the sight mounting may loosen and the kick from the rifle may cause the sight to move. Such movement and/or damage may not be readily apparent. In addition the zero of a rifle also varies between individual users. Consequently, if someone other than the owner uses the gun the zero of the rifle may have been changed.

It is clear that there is still a demand for a device to permit the zero of a firearm to be quickly checked without firing the rifle. The Johnson patent discloses one such device. As disclosed a blank cartridge form is attached to a second scope by a bracket. To use the rifle is first sighted in then the blank cartridge form is inserted into the rifle chamber and the device is rotated around the chamber until a stop device protruding from the bracket touches the rifle's scope. The rifle is then placed in a firm rest with the crosshairs of the rifle scope centered on a target at a known distance and the second scope then adjusted to indicate the same aiming point. If the owner is later unsure whether the scope has lost zero, a target can be set up at the same distance, the device again mounted to the rifle, and the two scopes viewed to determine whether the same impact point is indicated. If it is not, the rifle scope can then be adjusted to the spot indicated by the device scope.

Notwithstanding the above, it is presently believed that there is a need and a potential commercial market for a device and a method for aligning an adjustable sight for a firearm in accordance with the present invention. There should be a demand and a commercial market for such devices because such devices are believed to be of higher accuracy than the prior art devices, durable, and capable of being manufactured at a competitive price. Further, the devices in accordance with the present invention allow for the rapid zeroing of a firearm without firing the weapon.

BRIEF SUMMARY OF THE INVENTION

In essence the present invention contemplates a method for adjusting a gun sight to improve the accuracy of a firearm. The method includes the steps of providing a firearm with a longitudinally extending barrel having a bore with a longitudinally extending axis extending through the barrel and a gun sight with an adjustable member mounted on or fixed to the barrel.

The method also includes the step of providing a cylindrical body and a laser pointer disposed within said body and said body being constructed and dimensioned to fit within the barrel of the firearm so that the laser pointer projects a light beam along the longitudinal axis through the bore and outwardly therefrom to thereby form a light spot on a distant target. The gun sight is then adjusted so that it intersects with the light spot on the target. The sight is then fixed in that position and subsequently replaced with a bullet.

A further embodiment of the invention contemplates a device for zeroing an adjustable sight on a firearm of the type having a barrel, a longitudinally extending bore extending through the barrel and a longitudinally extending optical axis extending through the barrel. The device comprises or consists of a cylindrical generally bullet shaped metal body and a laser pointer disposed within the body and wherein the body is constructed and dimensioned to fit within the barrel of the firearm so that the laser pointer projects a light beam along the longitudinal axis through the bore and outwardly therefrom to thereby form a light spot on a distant target. In a preferred embodiment of the invention, there is a combination of a firearm and a device for aligning and adjusting an adjustable sight, said combination consisting of: a firearm having a breach, a longitudinally extending barrel having a forward portion and a rear portion, a bore extending through said longitudinally extending barrel and a longitudinally extending axis extending through said bore; a sight with an adjustment mechanism disposed on said barrel; and a device consisting of a metal body consisting of a forward cylindrical portion and a rear cylindrical portion with a larger diameter than said forward cylindrical portion abutting said forward cylindrical portion and wherein said forward cylindrical portion and said rear cylindrical portion are constructed out of a single piece of metal to provide an integral housing with a hollow chamber therein and an internally threaded rear portion, a metal disc externally threaded to screw into said rear portion to close the hollow chamber, a metal disc with a transparent window in the central part thereof closing a forward portion of said metal body, and a laser pointer and battery powering said laser pointer disposed in said rear cylindrical portion; wherein said forward cylindrical portion of said device is constructed and dimensioned to slidingly fit within a rear portion of said firearm through said breach and into said bore with the same tolerance as a bullet of suitable size for firing so that said laser pointer projects a light beam through said barrel along said longitudinally extending axis and out of said barrel to thereby form a light spot on a distant target so that said sight can be aligned with said light spot to thereby zero said firearm; and said laser pointer being a red/ orange diode pumped solid state laser to produce a laser beam with an output power of no greater than 1 milliwatt with a wavelength of about 635 nanometers.

The invention will now be described in connection with the accompanying drawings wherein like elements are identified by like numbers.

DESCRIPTION OF THE DRAWINGS

FIG. 4 is a schematic illustration showing the alignment of an open or peep sight in accordance with a method of the present invention; and FIG. 5 is a flow chart illustrating a method in accordance with the present invention.

DESCRIPTION OF THE PREFERRED EMBODIMENTS OF THE INVENTION

Figure 1:
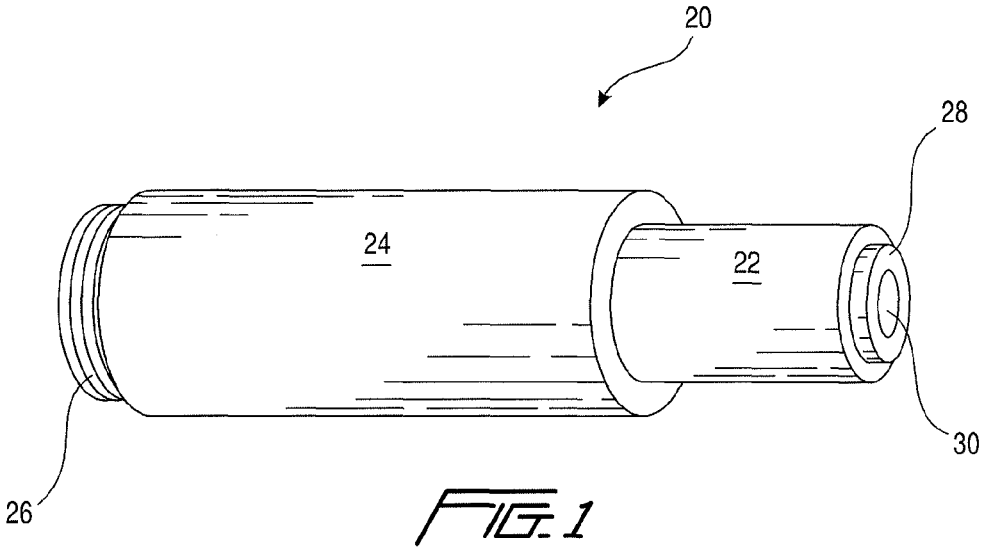
FIG. 1 is a schematic illustration of an alignment device in accordance with a first embodiment of the invention.

As illustrated in FIG. 1, a device 20 for checking the zero of a firearm includes a forward portion 22 and rear portion 24 and has the general shape of a bullet. As illustrated the rear portion 24 has a diameter which is slightly larger than the diameter of the forward portion 22. The forward portion 22 is constructed and dimensioned to slide into a rear portion of a firearm as for example through the breach of a firearm into the bore of the firearm with about the same tolerance as a bullet of suitable size for firing.

The rear portion 24 abuts the forward portion 22 and is of the same metal as for example having been machined out of a single piece of metal to provide an integral housing. The device 20 also includes a metal disc 26 that may be threaded to screw into internal threads in the rear portion 24 to close a hollow chamber (not shown in FIG. 1) that extends through the rear portion 24 that is adjacent to and extends into a forward portion of the hollow chamber through the forward portion 22.

The forward portion 22 of the device 20 is closed by a metal disc 28 and transparent window 30. The disc 28 is threadedly received in the forward portion 22.

Figure 2A:
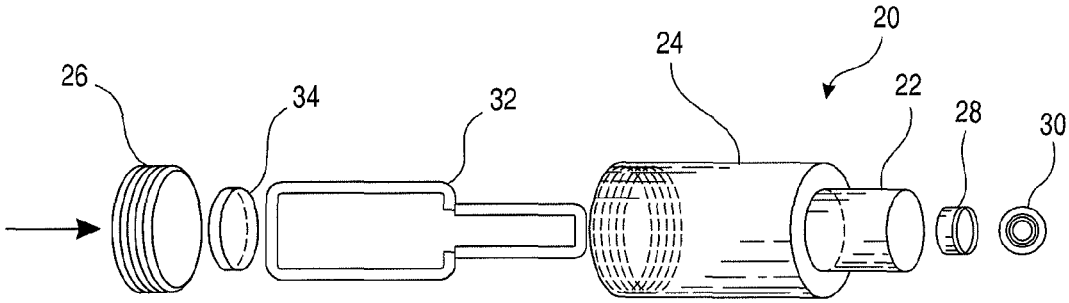
FIG. 2A is a schematic exploded view of the components of the device shown in FIG. 1.
Figure 2B:
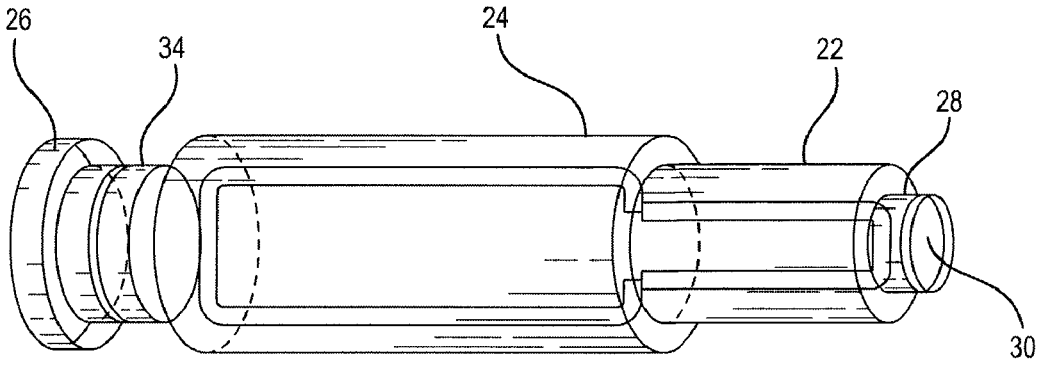
FIG. 2B is a schematic illustration of the components as put together in the device shown in FIG. 1.

As illustrated in FIG. 2, a laser pointer 32 and battery 34 are disposed in the hollow portion of the device 20 and are adapted for projecting a laser beam through the bore of a firearm (not shown in FIG. 1). The laser pointer 32 may be any of the small laser pointers designed to highlight something of interest by projecting a small bright spot of colored light onto a display as for example an image in a PowerPoint presentation.

However, laser pointers in accordance with a preferred embodiment of the invention produce a laser beam with an output power of no greater than one milliwatt (mW). These pointers are essentially battery powered laser diodes. Diode pumped solid state DPSS lasers and diode pumped solid state frequency doubled DPSSFD lasers are preferred. A first embodiment of the invention uses a red/orange laser that produces a beam with a wave length of about 635 nm.

A second preferred embodiment of the invention uses a green laser pointer that is more complicated than a standard red/orange laser. The green light is generated in an indirect process, beginning with a high-power (typically 100-300 mW) infrared AlGaAs laser diode operating at 808 nm. The 808 nm light pumps a crystal of neodymium-doped yttrium aluminum vanadate (Nd: $YVO_4$) (or Nd: YAG or less common Nd: YLF), which lases deeper in the infrared at 1064 nm. The vanadate crystal is coated on the diode side with a dielectric mirror that reflects at 1064 nm and transmits at 808 nm. The crystal is mounted on a copper block, acting as a heat sink; its 1064 nm output is fed into a crystal of potassium titanyl phosphate (KTP), mounted on a heat sink in the laser cavity resonator. The orientation of the crystals must be matched, as they are both anisotropic and the Nd: $YVO_4$ outputs polarized light. This unit acts as a frequency doubler, and halves the wavelength to the desired 532 nm. The resonant cavity is terminated by a dielectric mirror that reflects at 1064 nm and transmits at 532 nm. An infrared filter behind the mirror removes IR radiation from the output beam, and the assembly ends in a collimator lens.

Figure 3:
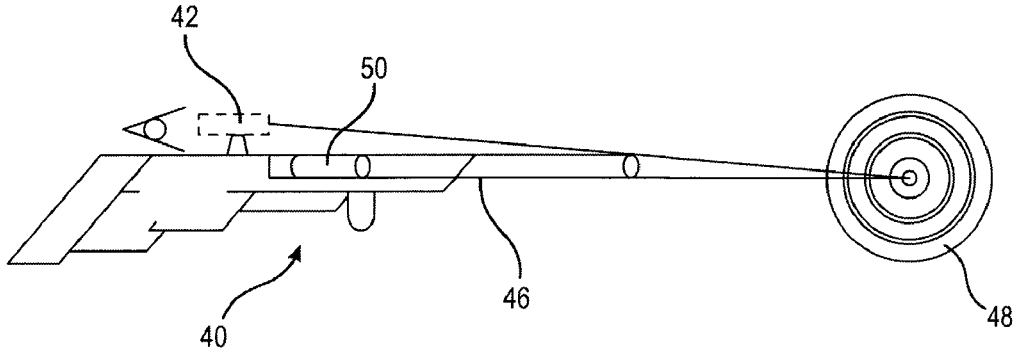
FIG. 3 is a schematic illustration of a second embodiment of the invention wherein a telescopic sight is fixed to a firearm.

A method for aligning an adjustable sight on a rifle will now be described in connection with FIG. 3 wherein a rifle 40 is equipped with an adjustable telescopic sight 42. A device 50 shown schematically projects a laser light beam through the rifle bore to project a light spot onto a distant target 48. It is presently believed that by projecting a laser light beam through a barrel or bore of a firearm will lead to improved results or accuracy as opposed to prior art devices that use an offset projector. The sight 42 is then adjusted so that a line of sight through the gun sight intersects the spot on the target. When the sight 42 has been fixed in this position the firearm is zeroed.

A similar approach to aligning a firearm or rifle 40 will now be described with respect to FIG. 4. As shown in FIG. 4, an open or peep sight 43 is adjustable by means of a conventional adjustment mechanism. As in the previous embodiment, a device 50 projects a laser beam of light through the bore 46 of a barrel 45 to form a light spot on the center of a distant target 48. When the line of sight using the peep sight 43 coincides with the light spot on the target 48 the sight is fixed in that position and the firearm is zeroed.

A method for aligning an adjustable sight on a firearm will now be described in connection with FIG. 5 and includes the step 60 of providing a firearm with a longitudinally extending barrel having a longitudinally extending bore extending through the barrel with a longitudinally extending axis extending through the bore. The firearm also includes a gun sight on the barrel such as an adjustable open or peep sight or an adjustable telescopic sight each of which includes a conventional adjustment mechanism. The method also includes the step 62 of providing an adjustment device having a cylindrical body with a lower portion disposed therein and wherein the cylindrical body is constructed and dimensioned to fit within the bore of a firearm. In step 64 a laser light beam is projected through the bore of the firearm to thereby form a visible light spot on a distant target 48 and in step 66 the line of sight through the gun sight is brought into register with the light spot on the target and the gun sight is fixed in that position to zero the firearm.

While the invention has been described in connection with its preferred embodiments it should be recognized that changes and modifications may be made therein without departing from the scope of the appended claims.

What is claimed is:

1. The combination of a firearm and a device for aligning and adjusting an adjustable sight, said combination consisting of:

a firearm having a breach, a longitudinally extending barrel having a forward portion and a rear portion, a bore extending through said longitudinally extending barrel and a longitudinally extending axis extending through said bore;

a sight with an adjustment mechanism disposed on said barrel; and a device consisting of a metal body consisting of a forward cylindrical portion and a rear cylindrical portion with a larger diameter than said forward cylindrical portion abutting said forward cylindrical portion and wherein said forward cylindrical portion and said rear cylindrical portion are constructed out of a single piece of metal to provide an integral housing with a hollow chamber therein and an internally threaded rear portion, a metal disc externally threaded to screw into said rear portion to close the hollow chamber, a metal disc with a transparent window in the central part thereof closing a forward portion of said metal body, and a laser pointer and battery powering said laser pointer disposed in said rear cylindrical portion; wherein said forward cylindrical portion of said device is constructed and dimensioned to slidingly fit within a rear portion of said firearm through said breach and into said bore with the same tolerance as a bullet of suitable size for firing so that said laser pointer projects a light beam through said barrel along said longitudinally extending axis and out of said barrel to thereby form a light spot on a distant target so that said sight can be aligned with said light spot to thereby zero said firearm; and said laser pointer being a red/orange diode pumped solid state laser to produce a laser beam with an output power of no greater than 1 milliwatt with a wavelength of about 635 nanometers.

* * * * *